US009622583B1

(12) United States Patent
Lv

(10) Patent No.: US 9,622,583 B1
(45) Date of Patent: Apr. 18, 2017

(54) FOLDING CHAIR

(71) Applicant: Feng Lv, Suzhou (CN)

(72) Inventor: Feng Lv, Suzhou (CN)

(73) Assignee: Hong Wang, Shenzhen (CN)

( * ) Notice: Subject to any disclaimer, the term of this patent is extended or adjusted under 35 U.S.C. 154(b) by 0 days.

(21) Appl. No.: 14/983,732

(22) Filed: Dec. 30, 2015

(30) Foreign Application Priority Data

Dec. 3, 2015 (CN) ..... 2015 2 0987100 U

(51) Int. Cl.
*A47C 4/28* (2006.01)
*A47C 5/10* (2006.01)

(52) U.S. Cl.
CPC ..... *A47C 4/286* (2013.01); *A47C 5/10* (2013.01)

(58) Field of Classification Search
CPC ..... A47C 5/10; A47C 4/286; A47C 4/28
USPC ..... 297/55, 45
See application file for complete search history.

(56) References Cited

U.S. PATENT DOCUMENTS 6,296,304 B1 * 10/2001 Zheng ..... A47C 4/286 297/21
6,634,705 B1 * 10/2003 Zheng ..... A47C 4/286 297/41
D706,050 S * 6/2014 Yang ..... D6/368
2004/0207236 A1 * 10/2004 Chen ..... A47C 4/42 297/45

* cited by examiner

*Primary Examiner* — Milton Nelson, Jr
(74) *Attorney, Agent, or Firm* — Wayne & King LLC

(57) ABSTRACT

A folding chair is provided. The folding chair comprises a chair framework and a chair cover installed on the framework. The framework comprises a back pipe, rear foot pipes, seat frame pipes, armrest pipes, armrest supporting pipes, a rear crossed pipe, a front crossed pipe and connecting pipes respectively arranged. The back pipe is respectively provided with a U-shaped hinge, a back sliding piece and a connection fixing piece from top to bottom. The back pipe is rotatably connected with one end of the rear foot pipes through the connection fixing piece; one end of the connecting pipes is rotatably connected with the back sliding piece sleeved on the back pipe; the middle is rotatably connected with the seat frame pipe; the other end of the connecting pipes is rotatably connected with the rear foot sliding piece sleeved on the rear foot pipe.

3 Claims, 4 Drawing Sheets

FOLDING CHAIR

CROSS-REFERENCE TO RELATED APPLICATIONS

This application is a continuation in part of, and claims priority to, Chinese Patent Application No. 201520987100.8 with a filing date of Dec. 3, 2015. The content of the aforementioned application, including any intervening amendments thereto, is incorporated herein by reference.

TECHNICAL FIELD

The invention relates to a folding chair capable of being completely contracted inwards.

BACKGROUND

With social development, outdoor sports are increasingly popular with people, while the requirement for outdoor sport products is higher and higher. A chair is needed by the activities of outdoor sports, fishing, etc. At the same time of ensuring the firmness of the chair, the chair shall be convenient to carry. The invention can realize folding and unfolding of a product through one action; the structural rigidity is good; fabric is stretched tightly on the bracket and uniformly stressed, making people feel more comfortable; the structure is compact; the folding chair has small volume after being folded, and is suitable for carrying and storage; and the folding chair has wide purposes and can be used in indoor places, outdoor sandy beaches, gardens, etc.

SUMMARY

The purpose of the invention is to provide a folding chair. Other pipes needed by the chair are connected by installing the connecting pieces on the back pipe from top to bottom. Using only one action, the unfolded chair can be rapidly folded to the center in a three-dimensional space, so the structure is ingenious.

To achieve the above purpose, the invention provides a folding chair, which comprises a chair framework and a chair cover installed on the framework, wherein the framework comprises a back pipe, rear foot pipes, seat frame pipes and connecting pipes respectively arranged on both sides; the back pipe is respectively provided with a U-shaped hinge, a back sliding piece and a connection fixing piece from top to bottom; the back pipe is rotatably connected with one end of the rear foot pipes through the connection fixing piece; one end of the connecting pipes is rotatably connected with the back pipe through the back sliding piece; the middle is rotatably connected with one end of the seat frame pipe; the other end of the connecting pipes is rotatably connected with the rear foot pipes through the rear foot sliding piece; a rear crossed pipe is arranged on the rear part of the framework; one end of the rear crossed pipe is rotatably connected with the upper part of the back pipe through the U-shaped hinge; the other end is rotatably connected with the lower parts of the rear foot pipes through the rear foot connecting piece so that the chair can be rapidly unfolded and folded and is firm.

The further improvement of the invention is that: The folding chair also comprises armrest pipes and armrest supporting pipes; the armrest pipes are rotatably connected with one end of the armrest supporting pipes; the other end is connected with the back pipe through the back sliding piece; the armrest supporting pipes are rotatably connected with the back pipe through the armrest supporting sliding piece sleeved under the back pipe; and the armrest pipes, the armrest supporting pipes and the seat frame pipe are rotatably connected through nodes, thereby enhancing the firmness of the chair to a certain degree and increasing the comfort of the chair.

The further improvement of the invention is that: a front crossed pipe is arranged on the front part of the framework; a seat frame connecting piece is arranged in the middle part of the armrest supporting pipe, the front part of the seat frame pipe is rotatably connected with the armrest supporting pipe through the seat frame connecting piece; one end of the front crossed pipe is rotatably connected with the armrest supporting pipe through the seat frame connecting piece; and the other end is rotatably connected with the back pipe through a front foot connecting piece. The front foot connecting piece plays a connection action (simultaneously comes into direct contact with the ground) and enhances the firmness and the stability of the bracket.

The invention has the beneficial effects of: ingenious structure, convenience in carrying and storage, strong practicality and beautiful appearance.

DETAILED DESCRIPTION

To expand the understanding of the invention, the invention will be further described in detail below in combination with the drawings and the embodiment.

Figure 1:
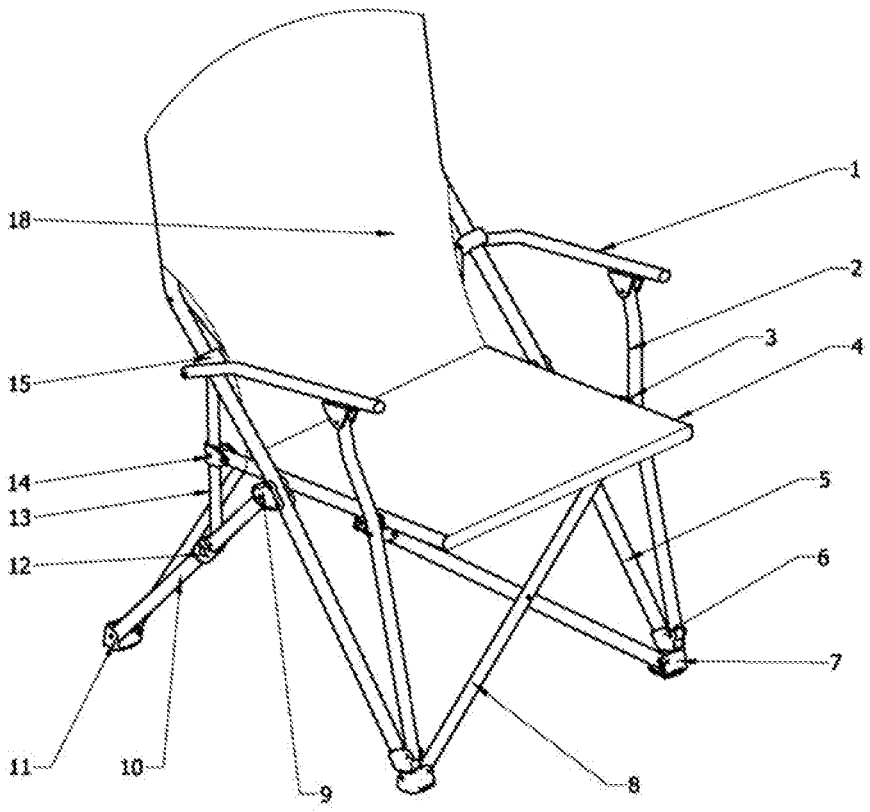
FIG. 1 shows a structural diagram of the invention.
Figure 2:
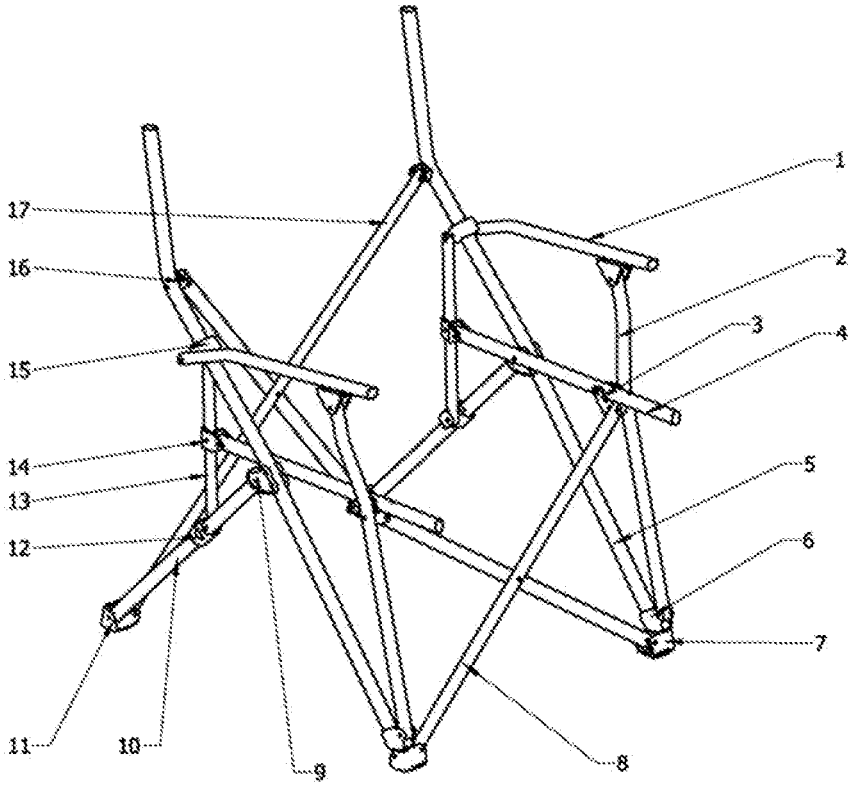
FIG. 2 shows a structural diagram of a framework of the invention.

Combining with FIG. 1 and FIG. 2, the invention proposes a folding chair, which comprises a chair framework and a chair cover 18 installed on the framework, characterized in that: wherein the framework comprises a back pipe 5, rear foot pipes 10, seat frame pipes 4, armrest pipes 1, armrest supporting pipes 2 and connecting pipes 13 respectively arranged on both sides; the back pipe 5 is respectively provided with a U-shaped hinge 16, a back sliding piece 15 and a connection fixing piece 9 from top to bottom; the back pipe 5 is rotatably connected with one end of the rear foot pipes 10 through the connection fixing piece 9; one end of the connecting pipes 13 is rotatably connected with the back sliding piece 15 sleeved on the back pipe 5; the middle is rotatably connected with the seat frame pipe 3; the other end of the connecting pipes 13 is rotatably connected with the rear foot sliding piece 12 sleeved on the rear foot pipe 10; the seat frame pipe 4 is rotatably connected with the back pipe 5 through the connection fixing piece 9; one end is rotatably connected with the connecting pipes 13; the other end is rotatably connected with the armrest supporting pipe 2 through the seat frame connecting piece; the armrest pipe 1, the armrest supporting pipe 2, the seat frame pipe 4 and the connecting pipe 13 form a rotating quadrangle structure; the back sliding piece 15 and the rear foot sliding piece 12 connected on both ends of the connecting pipe simultaneously drive a bracket; and the bracket is folded or unfolded through the angular change of the quadrangle.

A rear crossed pipe 17 is arranged on the rear part of the framework; one end of the rear crossed pipe 17 is rotatably connected with the upper part of the back pipe 5 through the U-shaped hinge 16; and the other end is rotatably connected with one end of the rear foot pipes 10 through the rear foot connecting piece 11; The folding chair also comprises armrest pipes 1 and armrest supporting pipes 2; the armrest pipes 1 are rotatably connected with one end of the armrest supporting pipes 2; the other end of the armrest pipes 1 rotatably connected with the back sliding piece 15 sleeved on the back pipe 5; and the other end of the armrest supporting pipes 2 is rotatably connected with the armrest supporting sliding piece sleeved on the back pipe 5; a front crossed pipe 8 is arranged on the front part of the framework; a seat frame connecting piece 3 is arranged in the middle part of the armrest supporting pipe 2; the front part of the seat frame pipe 4 is connected with the armrest supporting pipe 2 through the seat frame connecting piece 3; one end of the front crossed pipe 8 is movably connected with the armrest supporting pipe 2 through the seat frame connecting piece 3; and the other end is movably connected with the back pipe 5 on the other side through the armrest supporting sliding piece 6.

Figure 3:
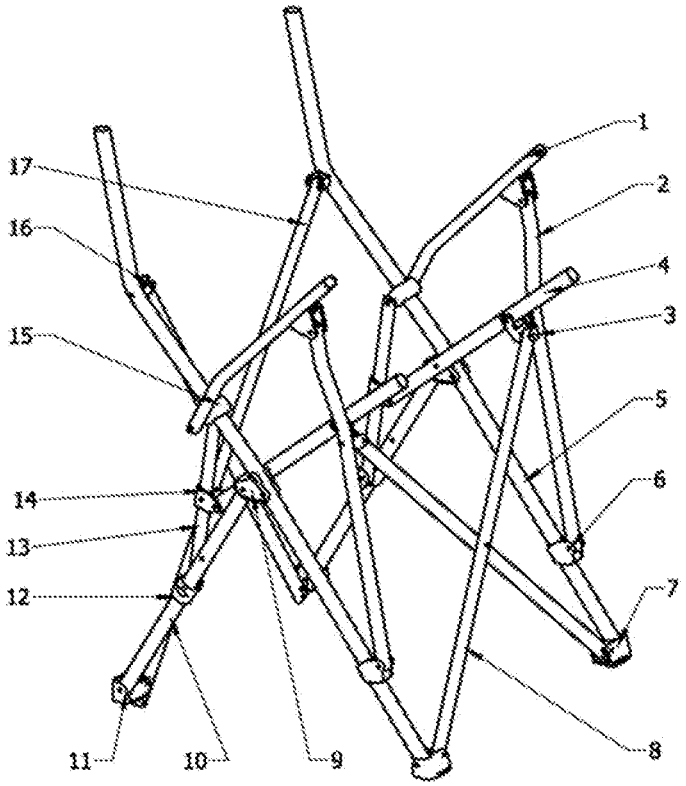
FIG. 3 shows a structural diagram of local folding of the invention.
Figure 4:
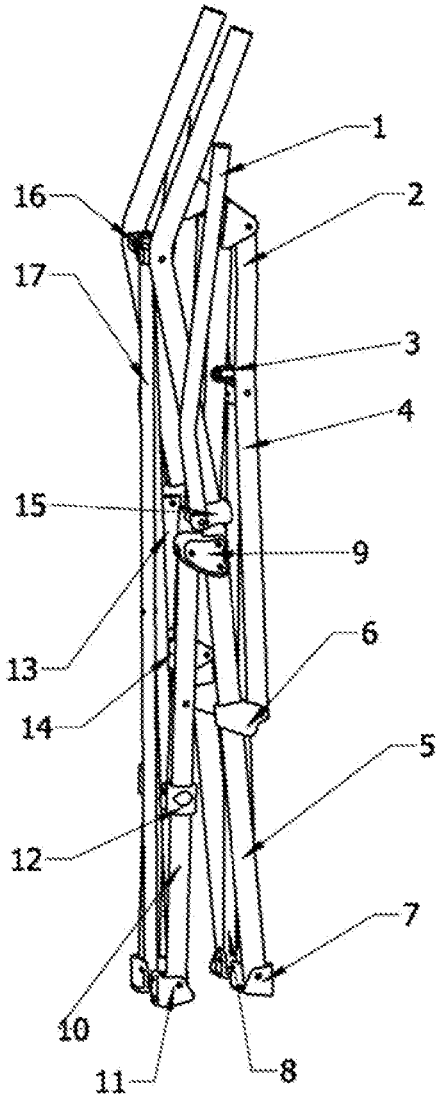
FIG. 4 shows a structural diagram of complete folding of the invention. Labels in the drawings: 1—armrest pipe; 2—armrest supporting pipe; 3—seat frame connecting piece, 4—seat frame pipe; 5—back pipe; 6—armrest supporting sliding piece; 7—front foot connecting piece; 8—front crossed pipe; 9—seat frame connecting piece; 10—rear foot pipe; 11—rear foot connecting piece; 12—rear foot sliding piece; 13—connecting pipe; 14—connecting pipe fixing piece; 15—back sliding piece; 16—U-shaped hinge; 17—rear crossed pipe; and 18—fabric.

Combining with FIG. 3 and FIG. 4, during contraction, the upper part of the back pipe 5 is held by hand; the front end of the seat frame pipe 4 on the same side is held by the other hand and is stressed inwards. The seat frame pipe 4 drives the armrest supporting pipe connected to the front end thereof to upwards slide at the same time, the other end of the seat frame pipe 4 drives the connecting pipe 13 connected to the rear part thereof to downwards rotate. The connecting pipe 13 downwards rotates to drive the back sliding piece 15 on the upper part thereof to downwards slide along the back pipe 5 for driving the rear foot sliding piece 12 under the connecting pipe 13 to downwards slide along the rear foot pipe 10, so that the rear foot pipe 10 rotates towards the direction of the back pipe 5 through the connection fixing piece 9 fixed to the middle of the back pipe 5. When the armrest supporting pipe 2 upwards moves, the lower part upwards slides along the lower part of the back pipe 5 through the armrest supporting sliding piece 6; the upper part drives the armrest pipe 1 to upwards rotate; and the back end of the armrest pipe 1 is hinged with the back sliding piece 15, and downwards slides along the back pipe 5 under the drive of the back sliding piece 15. The lower part of the back pipe 5 and the rear foot pipe 10 rotate inwards to drive the front crossed pipe 8 and the rear crossed pipe 17 to inwards rotate so that the whole framework is folded inwards. Otherwise, when the bracket is required to be unfolded, the upper part of the back pipe 5 and the front end of the seat frame pipe 4 are held by hands to unfold outwards.

I claim:

1. A folding chair, comprising a chair framework and a chair cover (18) installed on the framework, characterized in that: the framework comprises a back pipe (5), a rear foot pipe (10), a seat frame pipe (4), an armrest pipe (1), an armrest supporting pipe (2) and a connecting pipe (13) respectively arranged on both sides; the back pipe (5) is respectively provided with a U-shaped hinge (16), a back sliding piece (15) and a connection fixing piece (9) from top to bottom; the back pipe (5) is rotatably connected with one end of the rear foot pipe (10) through the connection fixing piece (9); one end of the connecting pipe (13) is rotatably connected with the back sliding piece (15) sleeved on the back pipe (5); the other end of the connecting pipe (13) is movably connected with a rear foot sliding piece (12) sleeved on the rear foot pipe (10); the middle of the connecting pipes (13) is rotatably connected with one end of the seat frame pipe (4); the seat frame pipe (4) is rotatably connected with the back pipe (5) through the connection fixing piece (9); one end of the seat frame pipe (4) is rotatably connected with the armrest supporting pipe (2) through a seat frame rotating piece (3); the other end is rotatably connected with the connecting pipe (13); a rear crossed pipe (17) is arranged on the rear part of the framework; one end of the rear crossed pipe (17) is rotatably connected with the upper part of the back pipe (5) through the U-shaped hinge (16); the other end is rotatably connected with one end of the rear foot pipe (10) through a rear foot connecting piece (11); the armrest pipe (1), the armrest supporting pipe (2), the seat frame pipe (4) and the connecting pipe (13) form a rotating quadrangle structure; the back sliding piece (15) and the rear foot sliding piece (12) connected on both ends of the connecting pipe simultaneously drive a bracket; and the bracket is folded or unfolded through the angular change of the quadrangle.

2. The folding chair according to claim 1, characterized by also comprising the armrest pipe (1) and the armrest supporting pipe (2); one end of the armrest pipe (1) is rotatably connected with the back sliding piece (15) sleeved on the back pipe (5); the other end is rotatably connected with the armrest supporting pipe (2); one end of the armrest supporting pipe (2) is rotatably connected with the armrest pipe (1); the middle of the armrest supporting pipe (2) is rotatably connected with the seat frame pipe (4) through the seat frame rotating piece (3); and the other end is rotatably connected with a armrest sliding piece (6) sleeved on the back pipe (5).

3. The folding chair according to claim 1, characterized in that: a front crossed pipe (8) is arranged on the front part of the framework; the seat frame rotating piece (3) is arranged in the middle part of the armrest supporting pipe (2); one end of the seat frame pipe (4) is rotatably connected with the armrest supporting pipe (2) through the seat frame rotating piece (3); one end of the front crossed pipe (8) is rotatably connected with the armrest supporting pipe (2) through the seat frame connecting piece (3); and the other end is rotatably connected with one end of the back pipe (5) through a front foot connecting piece (7).

* * * * *